US010836022B2

(12) United States Patent
Winefordner et al.

(10) Patent No.: US 10,836,022 B2
(45) Date of Patent: Nov. 17, 2020

(54) MULTIPLE TOOL

(71) Applicant: Selle Royal S.p.A., Pozzoleone (IT)

(72) Inventors: Carl Winefordner, Laguna Beach, CA (US); Frank Hermansen, Laguna Beach, CA (US)

(73) Assignee: SELLE ROYAL S.P.A., Pozzoleone (IT)

( * ) Notice: Subject to any disclaimer, the term of this patent is extended or adjusted under 35 U.S.C. 154(b) by 342 days.

(21) Appl. No.: 15/325,537

(22) PCT Filed: Jun. 25, 2015

(86) PCT No.: PCT/IB2015/054795
§ 371 (c)(1),
(2) Date: Jan. 11, 2017

(87) PCT Pub. No.: WO2016/005849
PCT Pub. Date: Jan. 14, 2016

(65) Prior Publication Data

US 2017/0157757 A1 Jun. 8, 2017

(30) Foreign Application Priority Data

Jul. 11, 2014 (IT) ..... VR2014A0181

(51) Int. Cl.

| | |
|---|---|
| ***B25B 27/00*** | (2006.01) |
| ***B25B 15/00*** | (2006.01) |
| ***B25H 3/00*** | (2006.01) |
| ***B25F 1/02*** | (2006.01) |
| ***B25F 1/00*** | (2006.01) |

(52) U.S. Cl.
CPC ..... *B25B 27/0071* (2013.01); *B25B 15/008* (2013.01); *B25F 1/00* (2013.01); *B25F 1/02* (2013.01); *B25H 3/006* (2013.01)

(58) Field of Classification Search
CPC ... B25B 27/0071; B25B 15/008; B25B 15/00; B25B 15/02; B25B 9/00; B25F 1/00; B25F 1/02; B25H 3/006; B25G 1/085
See application file for complete search history.

(56) References Cited

U.S. PATENT DOCUMENTS 1,360,121 A * 11/1920 Lawrence ..... B25B 13/06 81/124.4
5,186,083 A 2/1993 Hsiao
5,365,811 A * 11/1994 Chi ..... A63C 3/00 7/165

(Continued)

FOREIGN PATENT DOCUMENTS

DE 20211315 10/2002
WO 9730824 8/1997

(Continued)

*Primary Examiner* — Brian D Keller
(74) *Attorney, Agent, or Firm* — Tutunjian & Bitetto, P.C.

(57) ABSTRACT

A multiple tool, including at least one tool body provided with a central portion and radial portions departing from said central portion, each of said radial portions carrying a respective tool. The multiple tool further includes at least a frame provided with at least an opening for removably housing said at least one tool body, and with peripheral seats for removably housing respective implements.

13 Claims, 7 Drawing Sheets

(56) References Cited

U.S. PATENT DOCUMENTS

| | | | | |
|---|---|---|---|---|
| 5,713,252 | A * | 2/1998 | Iwinski | B25B 15/008 81/125.1 |
| 6,279,434 | B1 | 8/2001 | Brown | |
| 6,862,964 | B2 * | 3/2005 | Chen | B25B 13/56 81/177.4 |
| 7,243,578 | B2 * | 7/2007 | Burwell | B25B 13/56 81/124.4 |
| 7,305,907 | B2 * | 12/2007 | Burwell | B25B 13/56 81/177.2 |
| 7,387,055 | B2 * | 6/2008 | Liu | B25B 15/008 81/177.1 |
| 7,441,481 | B2 * | 10/2008 | Liu | B25B 13/463 81/124.4 |
| D744,796 | S * | 12/2015 | Hsieh | D8/25 |
| 2004/0246707 | A1 * | 12/2004 | Miyamoto | B25B 27/0071 362/119 |
| 2012/0043238 | A1 | 2/2012 | Brent | |
| 2013/0330212 | A1 * | 12/2013 | Wang | F04B 53/00 417/234 |

FOREIGN PATENT DOCUMENTS

| | | |
|---|---|---|
| WO | 2011101397 | 8/2011 |
| WO | 2013038232 | 3/2013 |

* cited by examiner

MULTIPLE TOOL

TECHNICAL FIELD OF THE INVENTION

The present invention relates to a multiple tool.

More specifically, the present invention relates to a multiple tool for the maintenance and repair of motorcycles, bicycles and the like, and their mechanical parts.

STATE OF THE ART

Multiple tools are known, particularly of the pocket type and then rather small, which allow the user to bring together in one portable object a number of implements, each one for a different use.

Some examples of these implements are wrenches, allen keys, screwdrivers, and the like.

Some known types of multiple tools are especially dedicated to the care, maintenance and repair of mechanical parts for cycles and motorcycles.

The user can then bring with himself the multiple tool, for example, when making excursions or trips by bicycle or motorcycle, so he can work out emergency situations, such as mechanical damage to the medium, boring tire punctures, and more.

Alternatively, the multiple tool can be simply used to make quick adjustments to the medium itself, such as raise or lower the saddle, mount or dismount accessories, and so on.

Portable multiple tools of the known type generally comprise a pivot around which said implements, adjacent one another, are rotatable from a minimum encumbrance retracted position to an operating position: this operating position is reached by manually rotating the implement around the pivot, starting from the retracted position, by a certain angle comfortable enough to use the implement by gripping the multiple tool.

Portable multiple tools are relatively heavy because they generally require two steel bolts for the tools to pivot around, two steel or aluminum frame members, and about half the weight of each tool is comprised by the portion that pivots around each bolt.

Some less portable tools that are commonly used in shops or at home are known as Y-tools, because each Y-tool is comprised of 3 tools joined at the center, each tool about 120° apart from the next.

Y-tools are more convenient to use than portable multiple tools, but they are rather inconvenient to carry, partly because of their shape, and partly because approximately ten different tools are commonly required for maintaining a bicycle, which would mean carrying three or four separate Y-tools.

Furthermore, carrying three or four separate Y-tools in a jersey pocket would be dangerous, as the tool tips could easily poke the person.

Additionally, other tools and accessories beyond Y-tools are sometimes required, such as a chain breaker, inflator, spoke wrenches, tire patch kit, and the like.

There is not a known convenient way to bundle Y-tools, or to additionally carry other needed tools beyond the Y-tools.

SUMMARY OF THE INVENTION

The technical aim of the present invention is therefore to improve the state of the art.

Within such technical aim it is an object of the invention to develop a light weight multiple tool that is more convenient to carry, and that can additionally carry other needed tools and accessories.

This aim and these objects are all achieved by the multiple tool according to the present specification.

According to the invention, the multiple tool comprises at least one tool body provided with a central portion and radial portions departing from the central portion; each of the radial portions carries a respective tool. The multiple tool further comprises at least a frame, provided with at least an opening for removably housing at least one tool body, and with peripheral seats for removably housing respective implements.

According to another aspect of the invention, the tool bodies are easily connected to a frame because of magnetic attraction.

According to a further aspect of the invention, all the implements can be easily engaged and disengaged from the frame.

One of the preferred embodiments of the multiple tool has a chain breaker that provides better leverage for turning the pin screw, and which can also be used as a spoke adjuster.

Other preferred embodiments of the multiple tool further comprise a tire inflator that comprises a valve that can be selectably opened or closed.

Other preferred embodiments of the multiple tool further comprise a storage container for tool bits.

Other alternative embodiments are not shown, but would be obvious to those skilled in the art.

The present application refers to preferred and advantageous embodiments of the invention.

BRIEF DESCRIPTION OF THE DRAWINGS

These and other advantages will be better understood by any man skilled in the art from the following description that follows and from the attached drawings, given as a non-limiting example, in which.

DETAILED DESCRIPTION OF THE INVENTION

Figure 1:
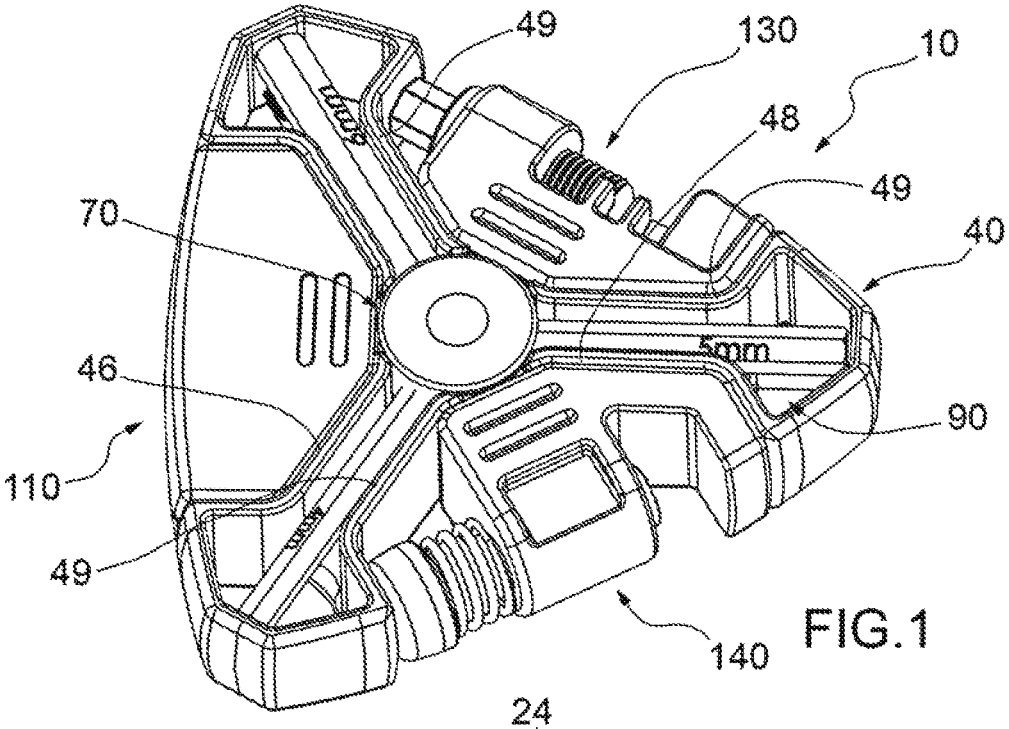
FIG. 1 is a perspective view of the multiple tool according to the invention.

With reference to the schematic representation of FIG. 1, a multiple tool according to the invention is wholly indicated with 10.

In the following embodiments individual characteristics, given in connection with specific embodiments, may actually be interchanged with other different characteristics that exist in other embodiments.

The multiple tool 10 comprises at least a tool body 70, 90.

The tool body 70, 90 comprises a central portion 22 and radial portions 24.

The radial portions 24 depart from the central portion 22.

Each of the radial portions 24 carries a respective tool 72, 74, 76, or 92, 94, 96.

According to an aspect of the present invention, the multiple tool 100 comprises at least a frame 40.

The frame 40 comprises a frame body 46.

The frame 40, and in particular its frame body 46, comprises at least an opening 41. The opening 41 is suitable for removably housing at least a tool body 70, 90.

According to another aspect of the invention, the frame 40, in more in particular the frame body 46, comprises peripheral seats 12, 14, 16.

The peripheral seats 12, 14, 16 are suitable for removably housing respective implements 110, 130, 140.

More in detail, the frame body 46 comprises a central region 48.

Furthermore, the frame body 46 comprises radial regions 49 departing from the central region 48.

The peripheral seats 12, 14, 16 are foreseen among the radial regions 49 of the frame body 46.

The opening 41 is passing through the frame body 46.

The opening 41 fully extends through the central region 48 and the radial portions 49 of the frame body 46.

The frame body 46 is made of a semi-rigid material.

For example, the frame body 46 is made of glass filled nylon polymer, or any other suitable material.

Each of the radial regions 49 of the frame body 46 comprise a widened end portion 50.

The widened end portion 50 comprises two respective lateral surfaces 52, 54.

The lateral surfaces 52, 54 of two adjacent widened end portions 50 are opposite to each other, and define a respective peripheral seat 12, 14, 16.

According to another aspect of the invention, each of the peripheral seats 12, 14, 16 comprises respective holding means 60 for the implements 110, 130, 140.

The holding means 60 foreseen in each of the peripheral seats 12, 14, 16 are suitable to removably retain the respective implement 110, 130, 140.

More in particular, the holding means 60 comprise at least two bumps 42, 43.

The bumps 42, 43 are foreseen on the lateral surfaces 52, 54 of two adjacent widened end portions 50.

The holding means 60 further comprise two respective recesses 44, 45 foreseen in each of the implements 110, 130, 140.

In particular, the recesses 44, 45 are foreseen on opposite sides of each of the implements 110, 130, 140, as better explained hereafter.

According to the invention, the bumps 42, 43 are elastically engageable in the respective recesses 44, 45.

Referring in particular to the embodiment of FIGS. 1-7, the multiple tool 10 comprise two tool bodies 70, 90.

In particular, the multiple tool 10 comprises a first tool body 70 and a second tool body 90.

The tool bodies 70, 90 are removably insertable in the opening 41 of the frame body 46.

According to a further aspect of the invention, the central portions 22 of the tool bodies 70, 90 comprise respective mutual connection means 80.

The mutual connection means 80 comprise at least a magnet 78.

The magnet 78 is foreseen on at least a face 79 of the central portion 22 of at least one of the tool bodies 70, 90.

More in detail, a face 79 of each of the tool bodies 70, 90 comprise a respective magnet 78.

The magnets 78 foreseen in the two tool bodies 70, 90 are mounted with reverse polarities, in order to generate a mutual attraction magnetic force.

Figure 3:
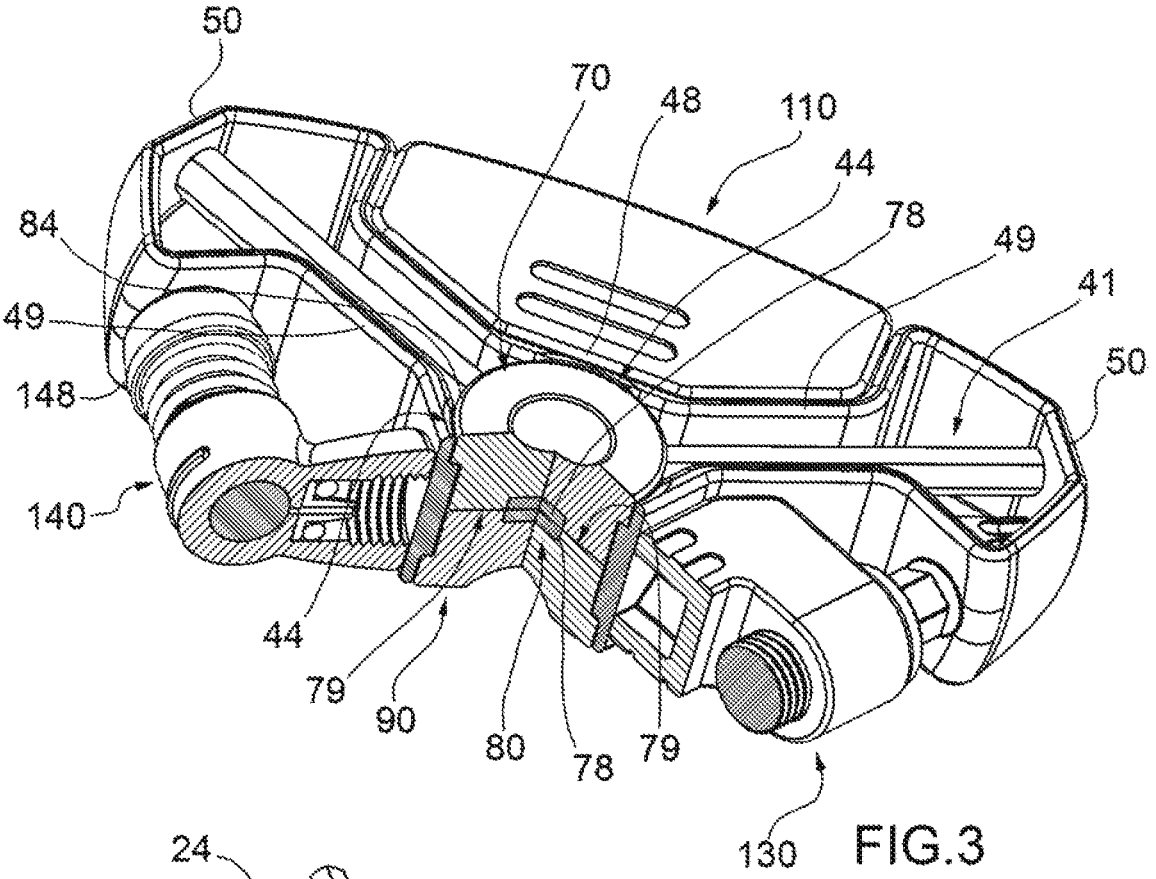
FIG. 3 is perspective partially sectioned view of the multiple tool.

As it can be clearly seen in FIG. 3, the tool bodies 70, 90 are mutually connected inside the opening 41 of the frame body 46, in a minimum encumbrance configuration.

The two tool bodies 70, 90 also magnetically connect to ordinary steel, such as for mounting directly to a steel wall strip for home or shop storage.

Figure 4:
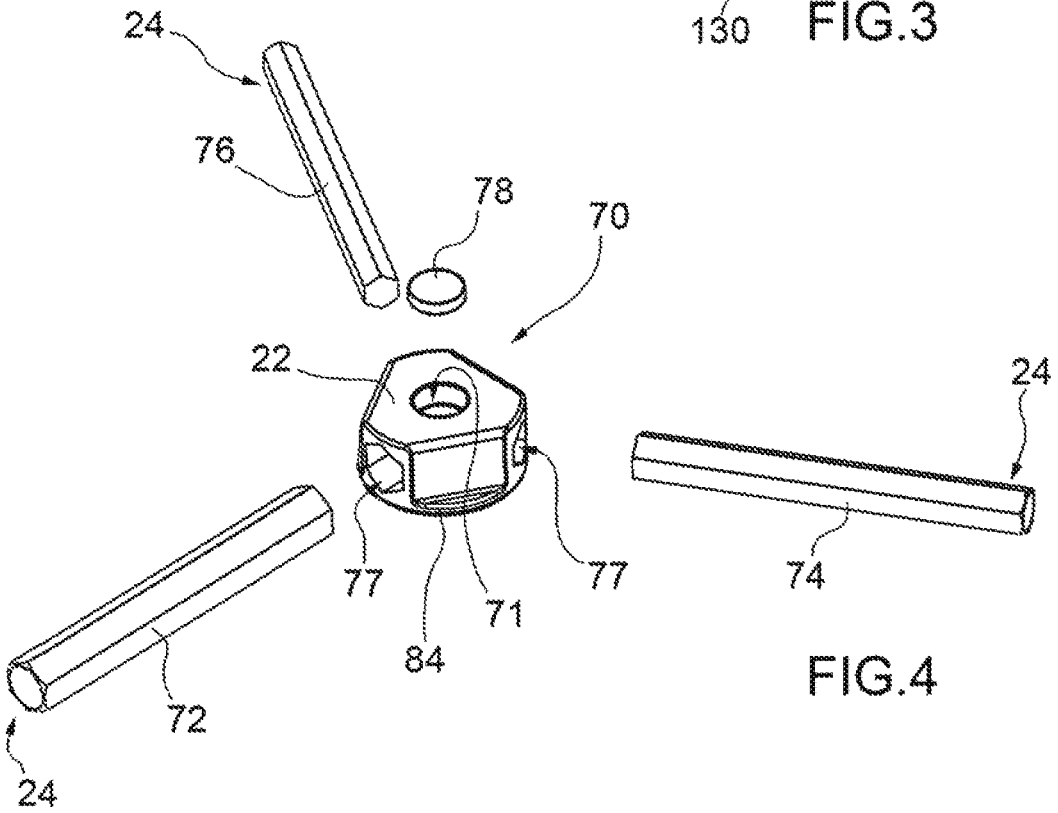
FIG. 4 is an exploded view of one of the Y-tools of the multiple tool shown in FIGS. 1-3.

The central portion 22 of each of the tool bodies 70, 90 comprise a flange portion 84, see for example FIG. 3 or 4.

Furthermore, the frame body 46 comprises notches 44 for the quick and easy extraction of each of the tool bodies 70, 90 from the opening 41.

The notches 44 are foreseen on both faces of the frame body 46, by the peripheral seats 12, 14, 16.

Figure 2:
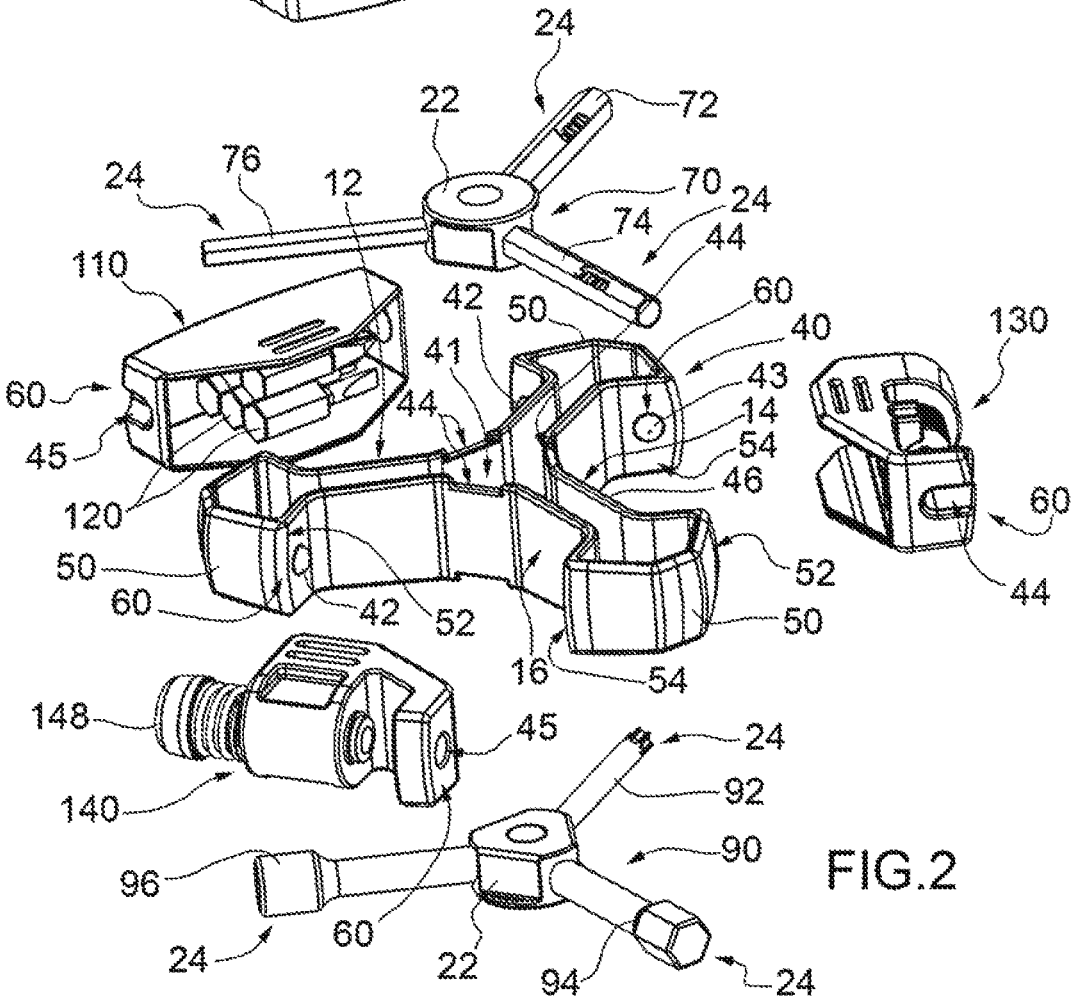
FIG. 2 is a partially exploded view of the multiple tool.

The flange portion 84 is suitable to rest on the respective notches 44—as shown in FIG. 2, 3—when the tool body 70, 90 is housed in the opening 41 in the configuration of minimum encumbrance.

The notches 44 allow the user to insert a finger under the flange portion 84 to remove the tool bodies 70, 90.

According to a further aspect of the present invention, each of the tool bodies 70, 90 is substantially "Y" shaped.

In particular, each of the tool bodies 70, 90 comprises three radial portions 24, angularly equidistant by 120°.

Referring to the first tool body 70, its radial portions 24 carry respective first tools 72, 74, 76.

For example, the first tool body 70 comprises a 6 mm hexagonal allen key 72, a 5 mm hexagonal allen key 74, and a 4 mm hexagonal allen key 76.

Referring to the second tool body 90, its radial portions 24 carry respective second tools 92, 94, 96.

Again for example, the second tool body 90 comprises a T-25 driver 92, an 8 mm hexagonal allen key 94, and a'/4 inch hexagonal socket 96.

FIG. 4 shows some design features of the first tool body 70.

The central portion 22 comprises an upper seat 71 and three side recesses 77.

The magnet 78 preferably press fits the upper seat 71 or, as an alternative, it is bonded inside said upper seat 71.

First tools 72, 74, 76 are bonded or press fit into the respective side recesses 77, and then possibly welded into place.

The second tool body 90 shows the same above disclosed design features.

Referring to FIG. 2, a first implement 110 is constituted by a storage container, for holding hexagonal tool bits 120, of any kind.

The container 110 comprises an opened side which is fully closed when the container is engaged in the respective peripheral seat 12.

Figure 5:
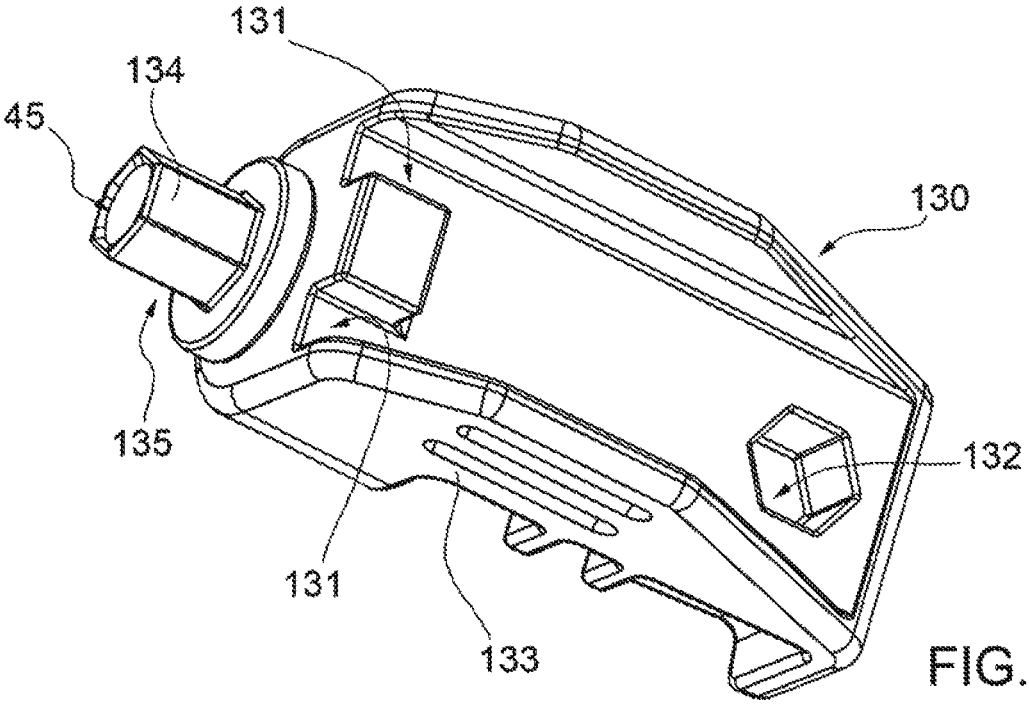
FIG. 5 is a perspective view of the chain breaker and spoke wrench shown in FIG. 2.

A second implement 130 is constituted by a chain breaker and spoke adjuster, shown for example in FIG. 5.

In particular, the chain breaker and spoke adjuster 130 comprises a body 133 and a screw 135.

The body comprises lateral recesses 44, 45.

The lateral recess 45 is foreseen in a'/4 inch hexagonal portion 134 of the screw 135.

The body 133 further comprises a 6 mm hexagonal recess 132, and two spoke adjustment recesses 131.

Figure 6:
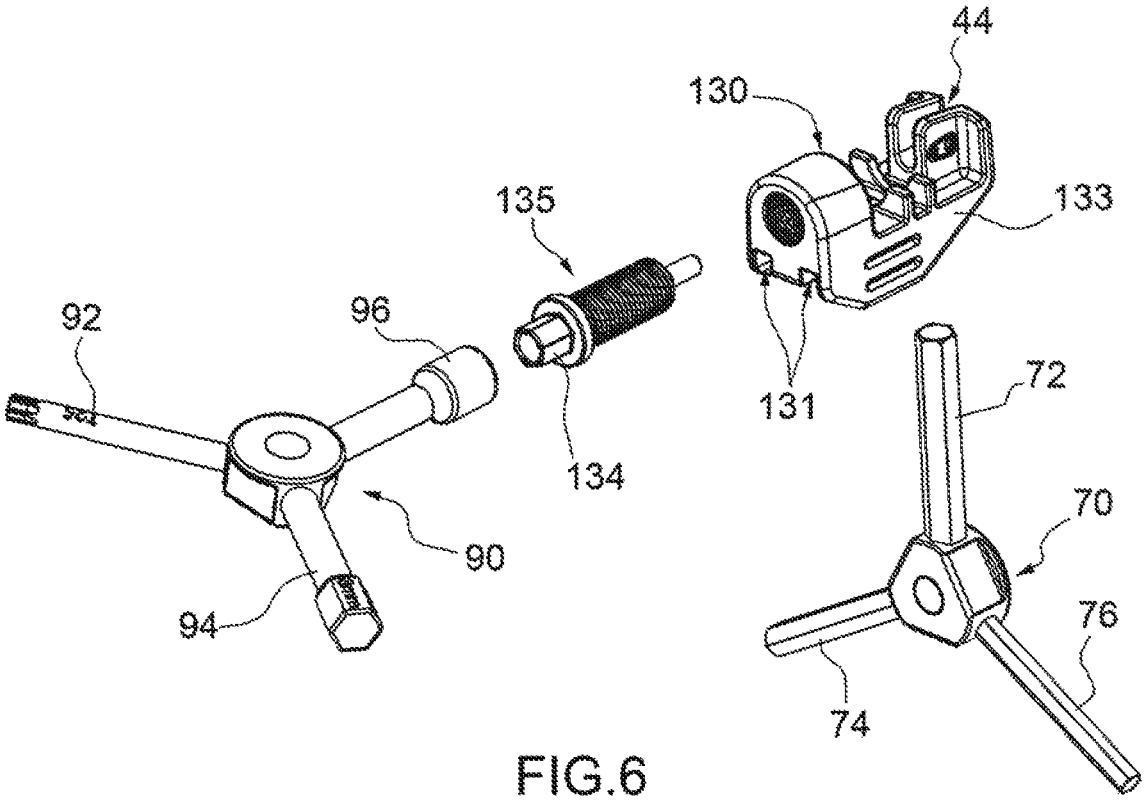
FIG. 6 is an exploded view of the chain breaker shown in FIG. 2 and ready for use.

In FIG. 6 the chain breaker and spoke adjuster 130 is shown ready for use as a chain breaker.

To easily and conveniently hold the chain breaker and spoke adjuster 130, the first tool 72—6 mm hexagonal allen key—fits into the 6 mm hexagonal recess 132 of body 133.

For easily turning the screw 135, the ¼ inch hexagonal socket 96 fits the ¼ inch hexagonal portion 134.

This configuration provides better screw leverage than traditional multiple tools.

In addition, this solution overcomes the drawbacks of the chain breakers foreseen on existing portable multiple tools, which do not provide long enough holds for turning in the screw, making it difficult to remove or install chain pins.

A third implement 140 is constituted by a tire inflator.

In particular, the tire inflator 140 comprises a body 146, and a tip 148.

Figure 7:
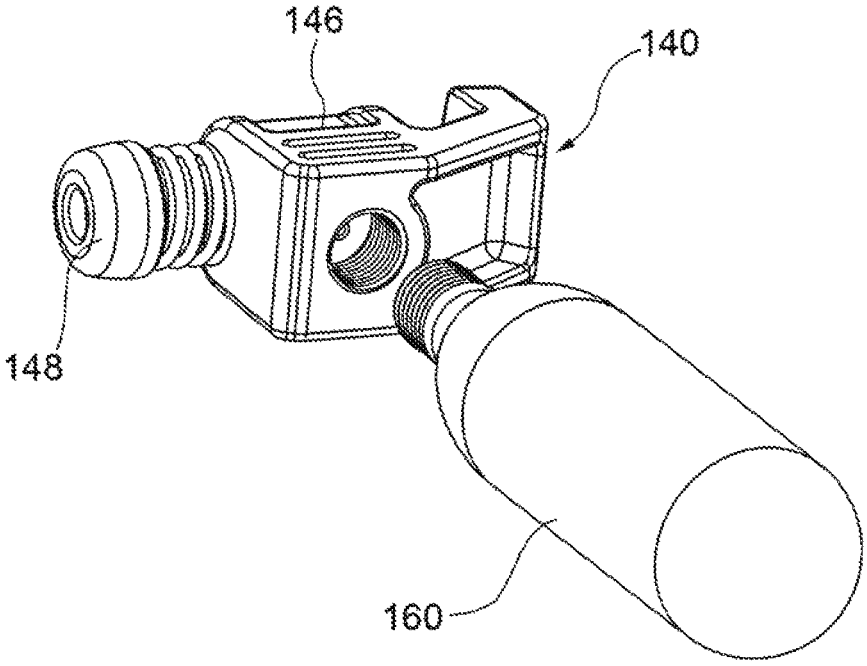
FIG. 7 is a perspective view of a gas cartridge ready for installation into the tire inflator shown in FIG. 2.

With reference to FIG. 7, when a gas cartridge 160 is fully screwed into the body 146 of the tire inflator 140, it becomes punctured, allowing pressurized gas to flow through the body 146.

The tip 148 is pressed onto a tire valve, and when the tip 148 is depressed hard enough, pressurized gas flows into the tire.

Each of the implements 110, 130, 140 can be easily housed inside respective peripheral seats 12, 14, 16.

In fact, during engagement, the frame body 46 flexes slightly, in order to allow bumps 42, 43 to engage with the respective recesses 44, 45.

Each of the implements 110, 130, 140 can be easily removed from the peripheral seats 12, 14, 16 as well.

Figure 8:
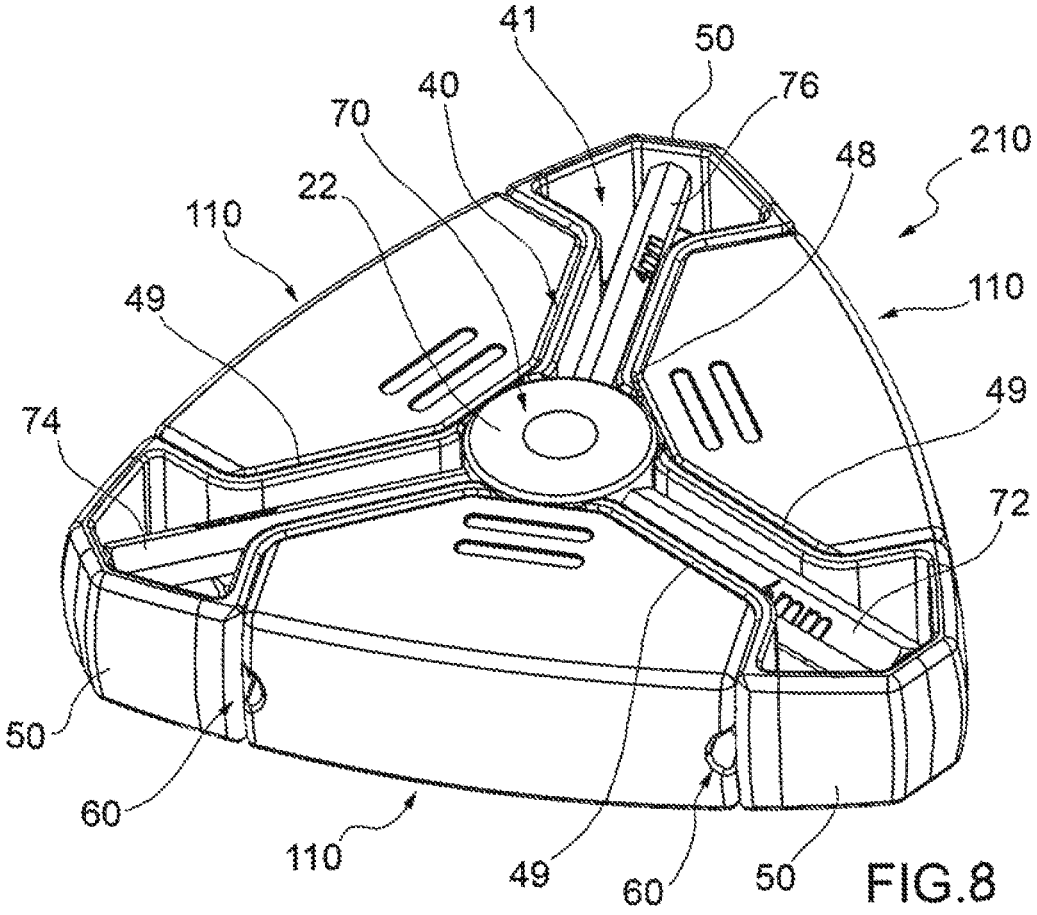
FIG. 8 is a perspective view of another embodiment of the multiple tool according to the invention.
Figure 9:
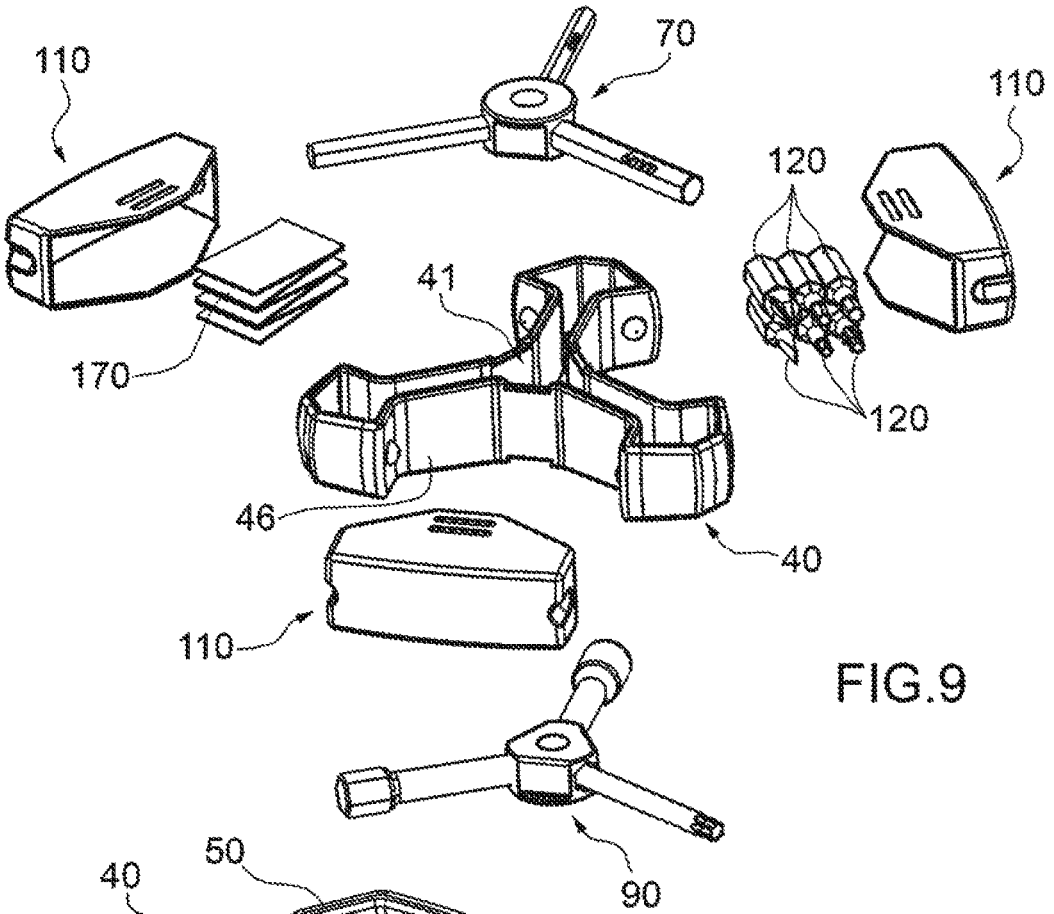
FIG. 9 is an exploded view of the multiple tool shown in FIG. 8.
Figure 10:
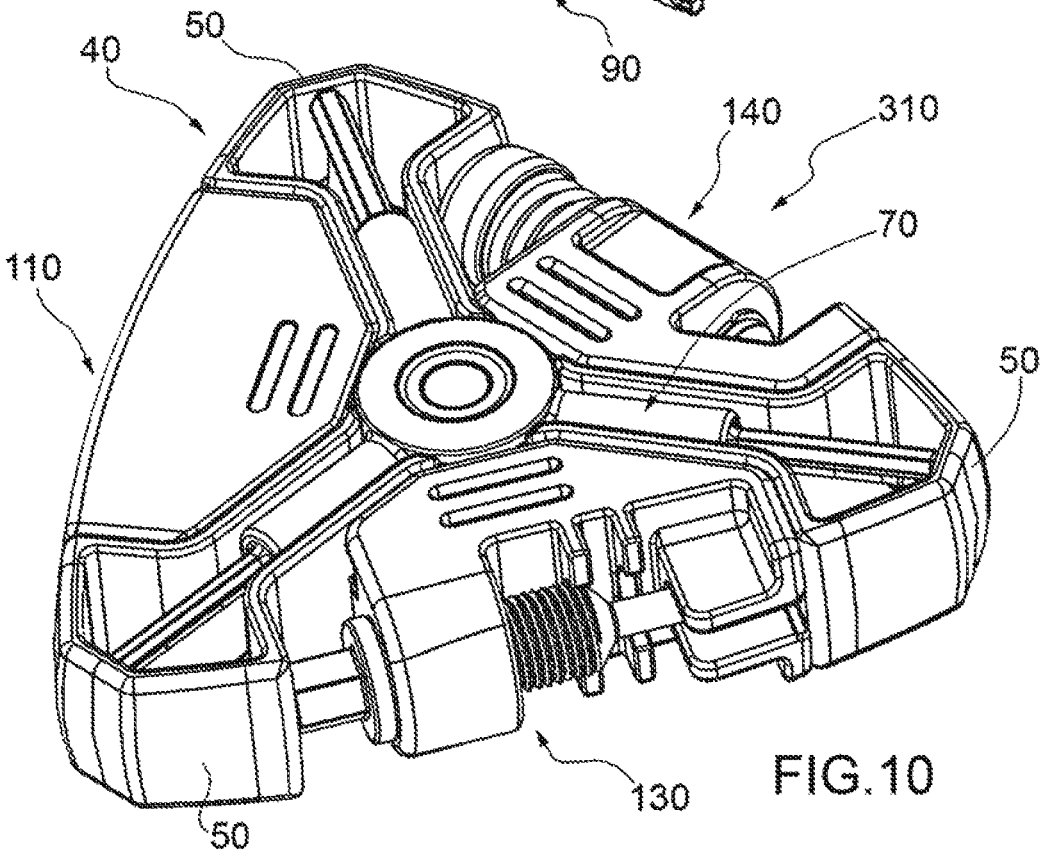
FIG. 10 is perspective view of another embodiment of the multiple tool according to the invention.

Another embodiment of the multiple tool according to the invention is shown in FIGS. 8, 9, wholly indicated with 210.

This embodiment of the invention differs from the previous embodiment in that is comprises three first implements 110 constituted by identical storage containers. Two of the storage containers 110 house respective tool bits 120, while a third storage container 110 holds, for example, an inner tube patch kit 170.

More in general, each of the storage containers 110 can hold whatever the user wants, such as money, medicine, a key, spare screws, and/or any other object suitable to fit inside the storage container 110.

This embodiment 210 of the invention has more storage space, and it is cheaper to manufacture than the previous embodiment.

The previous embodiments of the invention have been disclosed as comprising two tool bodies 70, 90.

Further embodiments of the invention, not shown in the attached figures, could comprise just one tool body 70 engaged in the opening 41 of the frame 40.

Another embodiment of the multiple tool according to the invention is shown in FIGS. 10-13, and wholly indicated with 310.

This embodiment differs from the one of FIGS. 1-7 in that it further comprises a third tool body 180, in addition to the first tool body 70 and to the second tool body 90.

The third tool body 180 has the same shape of the first and second tool bodies 70, 90.

The third tools 184, 186, 188 of the third tool body 180 can be of any kind previously disclosed.

Figure 13:
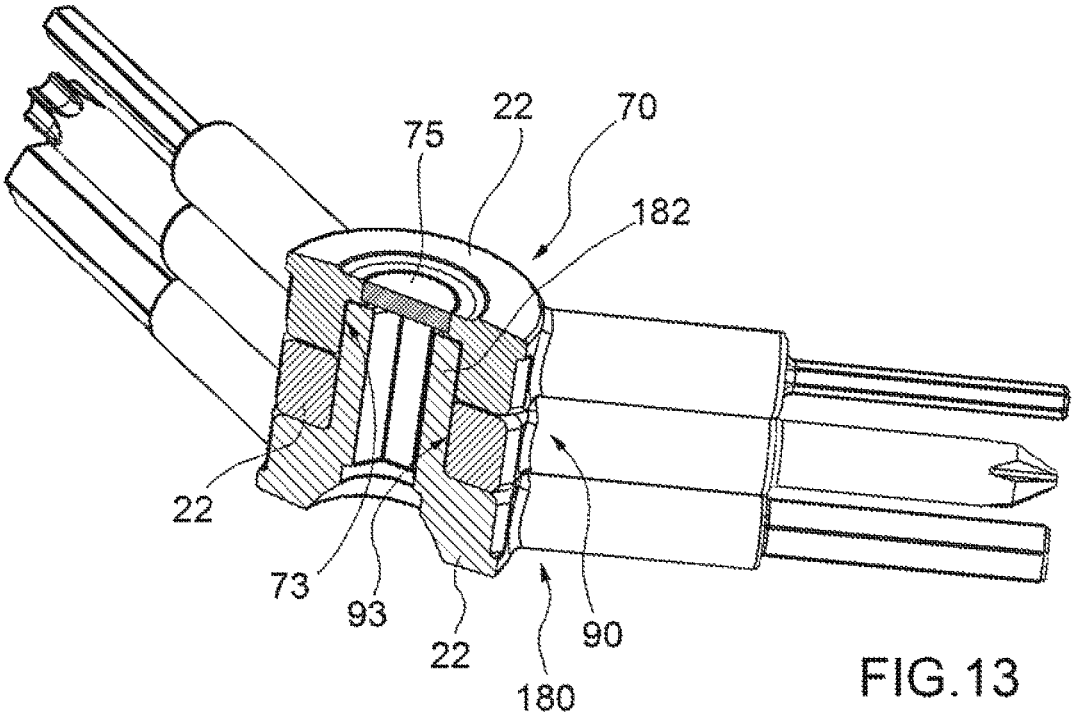
FIG. 13 is a perspective detailed and partially sectioned view of the multiple tool according to the embodiment of FIGS. 10-12.

The three tool bodies 70, 90, 180 are reciprocally connected, and held together inside the opening 41 of the frame body 46 as explained hereafter, and as better shown in FIG. 13.

The central portion 22 of the first tool body 70 comprises a lower seat 73, closed on top by a magnet 75.

The lower seat 73 has, for example, hexagonal cross section.

The central portion 22 of the second tool body 90 comprises a passing hole 93, having the same cross section of the lower seat 73, so for example hexagonal.

The central portion 22 of the third tool body 180 comprises an upper protrusion 182.

The upper protrusion 182 has the same cross section of the passing hole 93 and of the lower seat 73, so for example hexagonal.

The upper protrusion 182 is inserted into the passing hole 93, it engages the lower seat 73 of the first tool body 70, and therefore it contacts the magnet 75.

The three tool bodies 70, 90, 180 are thus safely held together inside the opening 41 of the frame body 46.

In addition, the rotation of the tool bodies 70, 90, 180 with respect to each other is prevented.

While in this embodiment of the invention the three tool bodies 70, 90, 180 are held together magnetically, it would also be possible to hold them together by using a light press fit, or other friction means.

Figure 12:
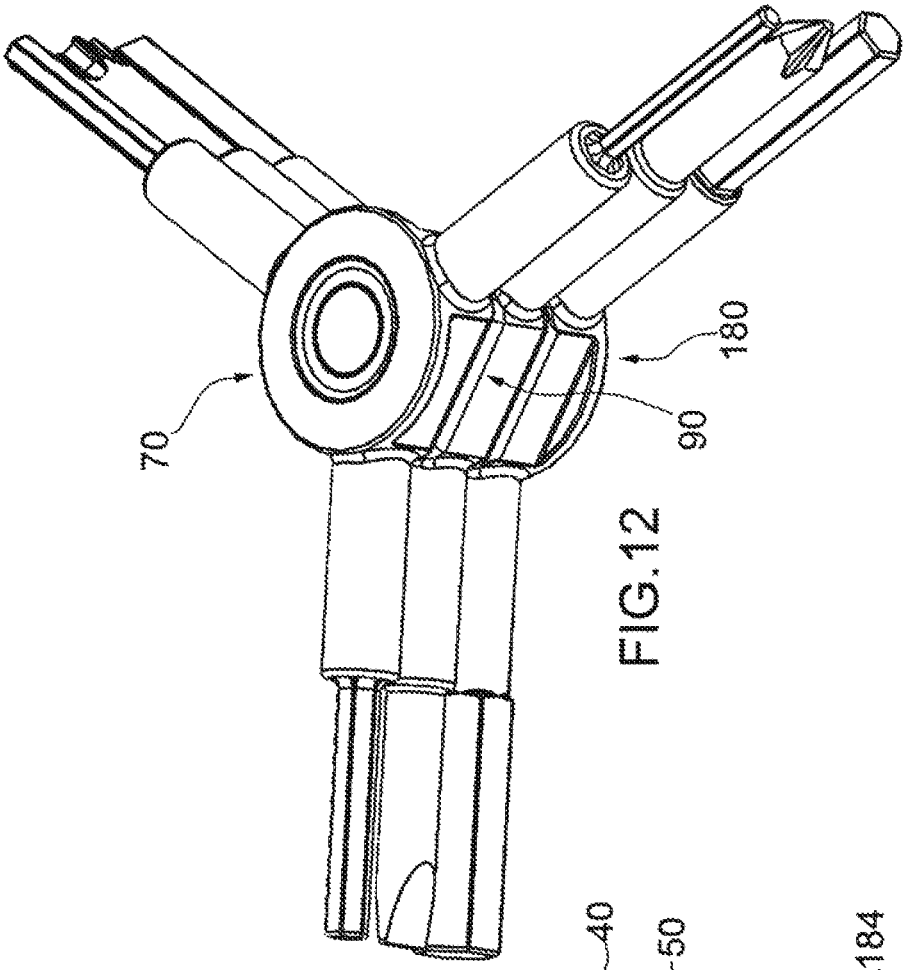
FIG. 12 is a perspective detailed view of the multiple tool according to the embodiment of FIGS. 10, 11.
Figure 11:
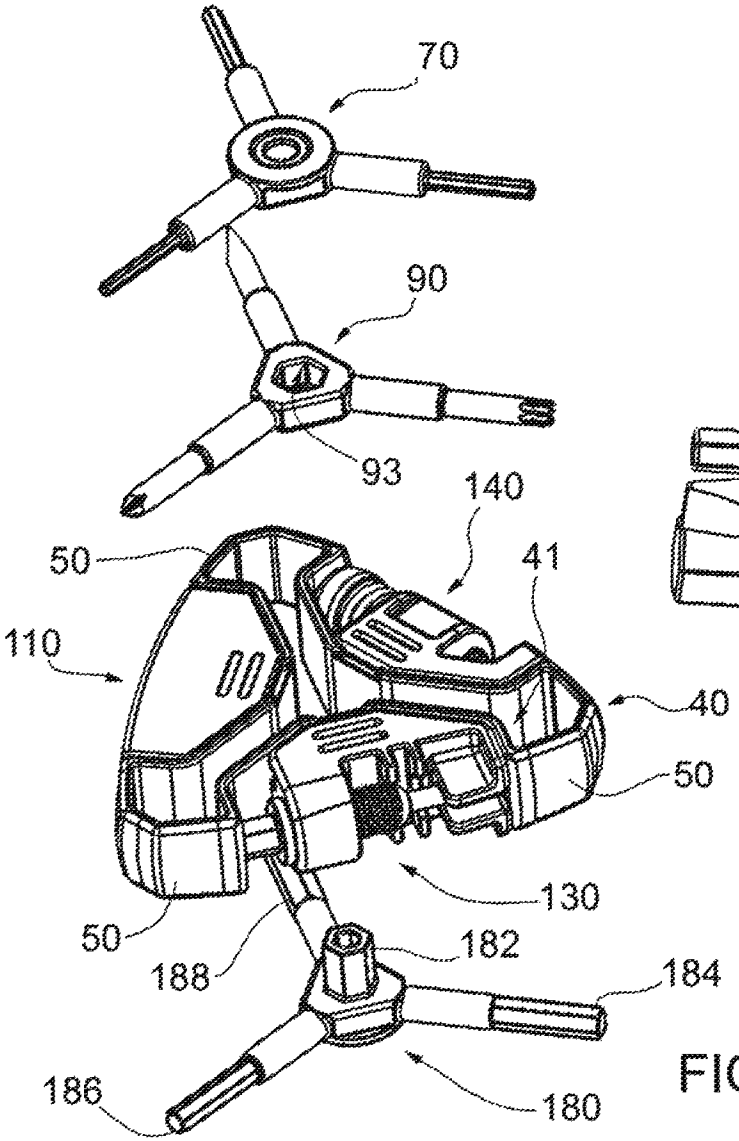
FIG. 11 is an exploded view of the multiple tool shown in FIG. 10.

As shown in FIG. 12, the three tool bodies 70, 90, 180 can also be used per se, without to need to engage them inside the opening 41 of the frame 40.

This configuration is best suited for home or shop use, rather than portability, and it offers a convenient way to keep multiple tools body together when not in use.

While in this embodiment three tool bodies 70, 90, 180 are described, almost any quantity of tool bodies—two or more—could be included.

Figure 14:
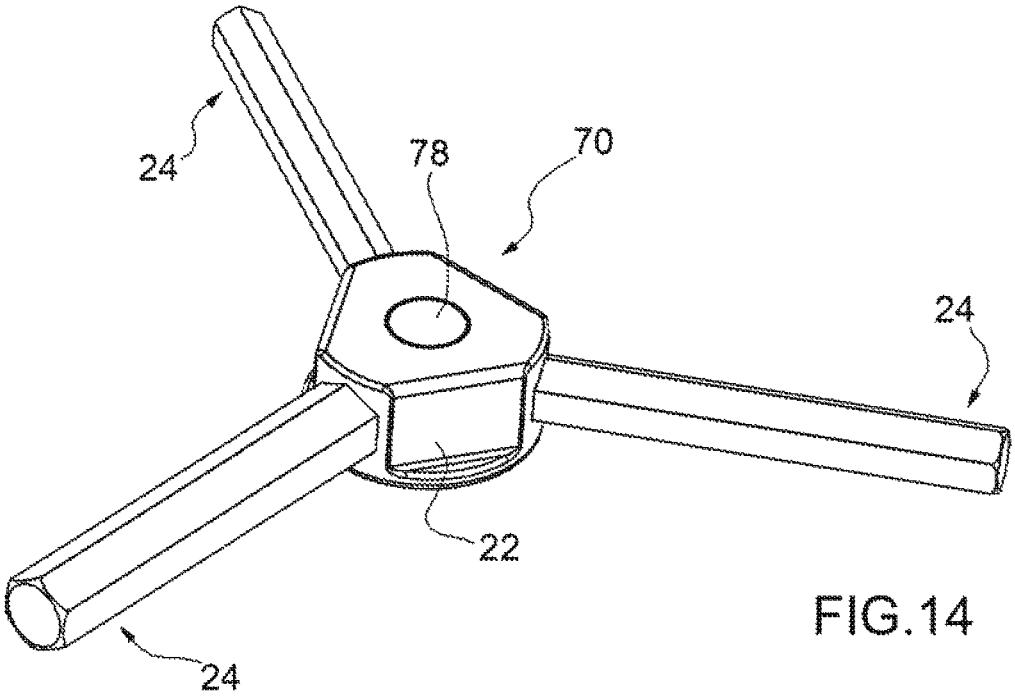
FIG. 14 is a perspective detailed view of another embodiment of the multiple tool according to the invention.

According to another embodiment of the invention, shown in FIG. 14, each of the tool bodies 70, 90, 180-disclosed in the previous embodiments—can be made of a single component.

In particular, in FIG. 14 the first tool body 70 is shown.

For example, the first tool body 70—or any other of the tool bodies 90, 180—could be forged or investment cast as a single piece.

The magnet 78—when foreseen—can be directly included inside the mold.

The multiple tool 10, 210, 310 according to the invention, in its assembled configuration, is compact, easy and safe to carry, and convenient to use.

Within such compact and convenient configuration, the multiple tool according to the invention allows carrying further implements 110, 130, 140 beyond the tool bodies 70, 90, 180.

The implements 110, 130, 140 to carry can be obviously chosen by the user from time to time among storage containers, chain breaker and tire inflator, since they can be easily and quickly engaged into the frame 40 and disengaged from it.

The present invention has been described according to preferred embodiments, but equivalent variants can be devised without departing from the scope of protection offered by the following claims.

The invention claimed is:

1. A multiple tool, comprising at least two tool bodies, each provided with a central portion and radial portions departing from said central portion, each of said radial portions carrying a respective tool, each of said tool bodies being "Y" shaped, and comprising three of said radial portions angularly equidistant, at least a frame comprising a frame body provided with at least one opening for removably housing said at least two tool bodies, and with peripheral seats provided in an outer surface of said frame body for removably housing respective implements, each of said tool bodies being able to be used per se, without the need to be engaged inside said at least one opening, said frame body having a central region and radial regions departing from said central region, said at least one opening passing through said frame body and fully extending through said central region and said radial regions of said frame body, so that said tool bodies can be engaged into said at least one opening, and extracted from said at least one opening to be used, from opposite sides of said frame body, at least one of said central portions of said tool bodies comprising a mutual connection means comprising at least a magnet on at least a face of said central portion, said tool bodies being mutually connected by mutual attraction force inside said at least one opening of said frame body.

2. The multiple tool according to claim 1, wherein said peripheral seats are provided among said radial regions of said frame body.

3. The multiple tool according to claim 2, wherein said frame body is made of a semi-rigid material.

4. The multiple tool according to claim 3, wherein each of said radial regions comprises a widened end portion having two outer lateral surfaces, the outer lateral surfaces of two adjacent widened end portions defining a respective one of the peripheral seats.

5. The multiple tool according to claim 1, comprising at least three of said tool bodies, wherein said mutual connection means comprise an upper protrusion departing from the central portion of the third tool body, a passing hole provided in the central portion of the second tool body, and a lower seat with a magnet foreseen in the central portion of the first tool body, said upper protrusion being suitable to contact said magnet in order to hold together said tool bodies in a minimum encumbrance configuration.

6. The multiple tool according to claim 5, wherein said upper protrusion, said passing hole and said lower seat have respective cross sections having a same shape.

7. The multiple tool according to claim 1, further comprising at least one implement removably housed in the peripheral seats, wherein said at least one implement comprises a container for storing objects, said container comprising an opened side which is fully closed when said at least one implement is engaged in the respective peripheral seat.

8. The multiple tool according to claim 1, further comprising at least one implement removably housed in the peripheral seats, wherein said at least one implement comprises at least one of a chain breaker and a spoke adjuster.

9. The multiple tool according to claim 1, further comprising at least one implement removably housed in the peripheral seats, wherein said at least one implement comprises a tire inflator.

10. The multiple tool according to claim 1, wherein said tool body is made of a single component.

11. The multiple tool according to claim 1, wherein said tools comprise hexagonal allen keys, screw drivers and hexagonal sockets.

12. The multiple tool according to claim 1, wherein said frame is made of glass filled nylon polymer.

13. The multiple tool according to claim 1, wherein said central portion of each of said tool bodies comprise a flange portion, and wherein said frame body comprises notches provided on each of two faces of the frame body, by said peripheral seats, said flange portion of each of said tool bodies being suitable to rest on said respective notches when said tool body is housed in said at least one opening.

* * * * *